US009094760B2

(12) United States Patent
Kaneko et al.

(10) Patent No.: US 9,094,760 B2
(45) Date of Patent: Jul. 28, 2015

(54) EARPHONE

(75) Inventors: Tomonari Kaneko, Yamato (JP); Yoshimi Aoyagi, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/172,327

(22) Filed: Jun. 29, 2011

(65) Prior Publication Data

US 2011/0317864 A1 Dec. 29, 2011

(30) Foreign Application Priority Data

Jun. 29, 2010 (JP) ..... 2010-147291

(51) Int. Cl.

| | |
|---|---|
| ***H04R 1/02*** | (2006.01) |
| ***H04R 1/10*** | (2006.01) |
| *H04R 1/06* | (2006.01) |
| *H04R 1/28* | (2006.01) |
| *H04R 11/02* | (2006.01) |

(52) U.S. Cl.

CPC ..... *H04R 1/1066* (2013.01); *H04R 1/021* (2013.01); *H04R 1/025* (2013.01); *H04R 1/06* (2013.01); *H04R 1/1016* (2013.01); *H04R 1/1033* (2013.01); *H04R 1/1075* (2013.01); *H04R 1/2803* (2013.01); *H04R 1/2896* (2013.01); *H04R 11/02* (2013.01)

(58) Field of Classification Search

USPC ..... 381/328, 329, 395

See application file for complete search history.

(56) References Cited

U.S. PATENT DOCUMENTS

| | | | | |
|---|---|---|---|---|
| 4,729,451 | A * | 3/1988 | Brander et al. | 181/130 |
| 4,870,688 | A * | 9/1989 | Voroba et al. | 381/60 |
| 7,570,774 | B2 * | 8/2009 | Jeong et al. | 381/186 |
| 8,139,806 | B2 | 3/2012 | Hosaka et al. | |
| 2010/0220884 | A1 * | 9/2010 | Aquilina et al. | 381/328 |

FOREIGN PATENT DOCUMENTS

| | | |
|---|---|---|
| JP | 2005-191663 A | 7/2005 |

* cited by examiner

*Primary Examiner* — Davetta W Goins
*Assistant Examiner* — Amir Etesam

(57) ABSTRACT

Solution Means: Earphone 10 possesses an outer ear canal insertion member for which at least a portion can be inserted into the outer ear canal, housing 11 onto which the outer ear canal insertion member can be installed and removed, and driver unit 41 which is disposed within housing 11 and which generates sound, and driver unit 41 is maintained within the interior space of the support member by the rigid support member being installed within housing 11.

16 Claims, 12 Drawing Sheets

Prior art

EARPHONE

REFERENCE To RELATED APPLICATIONS

The Present Disclosure is a U.S. National Phase Application of PCT Patent Application claims priority to prior-filed Japanese Patent Application No. 2010-247291, entitled "Earphone," filed on 29 Jun. 2010 with the Japanese Patent Office. The content of the aforementioned Patent Application is fully incorporated in its entirety herein.

BACKGROUND OF THE PRESENT DISCLOSURE

This Present Disclosure relates to earphones that possess an outer ear canal insertion component for which at least a portion is to be inserted into the outer ear canal.

Formerly, as an earphone used by being mounted on the outer ear, there have been known those of the type called earphone headphones, which do not provide a protrusion to be inserted into the outer ear canal, and so-called insertion type earphones, which insert into the outer ear canal an ear pad constituted of such as soft rubber having elasticity (see Japanese Patent Application No. 2008-109206, for example).

FIG. 12 is an exploded view drawing that shows the structure of the former technology earphone. In the drawing, 811 is the earphone housing, and within housing 811 there is installed driver unit 841 that provides a vibration plate. Additionally, at the leading end of housing 811 (lower right end in the drawing), there is integrally connected the base end of acoustic conduit 817 which extends in toward the lower right. Within acoustic conduit 817 there is formed a sound conducting hole with passage through the space within housing 811, and inner cylinder member 817*a* is inserted. At the periphery of acoustic conduit 817 there is mated and attached ear pad 850 constituted of such as a soft rubber. As such, when the earphone is mounted, the leading end of ear pad 850 is inserted into the outer ear canal. Sound generated by vibration of the vibration plate of driver unit 841 passes through the hole within acoustic conduit 817 and ear pad 850 and enters the interior of outer ear canal, after which it arrives at the eardrum.

Furthermore, at the aft end of housing 811 (left upper end in the drawing), there is installed cover casing 814, and between cover casing 814 and housing 811 there is disposed cable support 815 having a duct shape that extends downward. Within cable support 815 there is housed electric cable 891. Lead wire 892 is exposed from one end of this electric cable 891, and the leading end of the lead is connected with conductive capacity to driver unit 841. The other end of electric cable 891, which extends from the lower end of cable support 815, is connected to an audio device not shown in the drawing, being such as a music player, television, radio, or video deck.

If electric cable 891 is pulled from the outer side, there is potential for the connection with driver unit 841 to become broken, and electric cable 891 may become separated from housing 811 and cable support 815. For that reason, knot 891*a* is formed at the end section of electric cable 891, and it is housed in a space within cover casing 814. Knot 891*a* is of a size sufficiently larger than the inner diameter of cable support 815 that it will catch on the upper edge of cable support 815 when electric cable 891 is pulled from the outer side, and therefore it functions as a stopper. This enables preventing the separation of electric cable 891.

Moreover, cylinder-shaped first elastic member 871 is disposed and box-shaped second elastic member 872 is disposed, in a formation to enclose the periphery of driver unit 841. First elastic member 871 and box-shaped second elastic member 872 are constituted of an elastic material such as silicon rubber, synthetic rubber, or an elastomer, they are disposed so as to be embedded between the inner surface of housing 811 and the outer surface of driver unit 841, and they position driver unit 841 while elastically supporting driver unit 841 fore and aft and around the periphery.

However, with the earphone of the prior art described above, first elastic member 871 and box-shaped second elastic member 872 set the position of driver unit 841 within housing 811, and therefore a deformation of first elastic member 871 and box-shaped second elastic member 872 reduces the precision of the placement of driver unit 841. In particular, if a manual operation is used to install driver unit 841, first elastic member 871 and box-shaped second elastic member 872 to within housing 811, it may generate large variations in the amount of deformation of first elastic member 871 and box-shaped second elastic member 872, thereby greatly reducing the precision of the placement of driver unit 841.

Furthermore, because first elastic member 871 and box-shaped second elastic member 872 are embedded between the inner surface of housing 811 and the outer surface of driver unit 841, and because they adhere to the outer surface of driver unit 841, there is inability to maintain a space at the periphery of driver unit 841. Even though the space within housing 811 is a acoustic space that applies significant impact on the acoustic performance of the earphone, that space is occupied by first elastic member 871 and box-shaped second elastic member 872, and thereby the acoustic performance of the earphone is impaired.

SUMMARY OF THE PRESENT DISCLOSURE

This Present Disclosure solves the above described problems with the former technology earphone, and it has as its purpose the offering of compact high audio quality earphone by supporting the outer surface of the driver unit through use of a rigid support member, of a simple structure, installed within the housing, which thereby enables maintaining the driver unit with high precision in the placement, enables maintaining of a space at the periphery of the driver unit, and enables reduction of cost with easy manufacturing.

With the earphone of this Present Disclosure, there is an earphone that possesses an outer ear canal insertion member for which at least a portion can be inserted into the outer ear canal, a housing onto which the outer ear canal insertion member can be installed and removed, and a driver unit that is disposed within the housing and that generates sound, and by use of a rigid support member installed within the housing, the driver unit is supported within an interior space of the support member.

Additionally, with the earphone of this Present Disclosure, the described support member provides a plurality of unit support protrusions that protrude in the inward direction, and the outer surface of the described driver unit contacts the leading edge of the unit support protrusion, providing separation from the inner surface of the support member.

Furthermore, with the earphone of this Present Disclosure, the interior space of the support member includes both a side space at the outer side of the outer surface of the driver unit and an aft space at the aft side of the aft surface of the driver unit, and the side space and aft space are linked.

Moreover, with the earphone of this Present Disclosure, a partition is disposed at the forward surface and/or at the aft surface of the described support member.

By use of this Present Disclosure, there results an earphone that supports the outer surface of the driver unit by use of a rigid support member installed within the housing. As such, there is offering of compact high audio quality earphone, of a simple structure, that reduces cost and can be easily manufactured, by supporting the driver unit with high precision in the placement, and by maintaining a space at the periphery of the driver unit.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
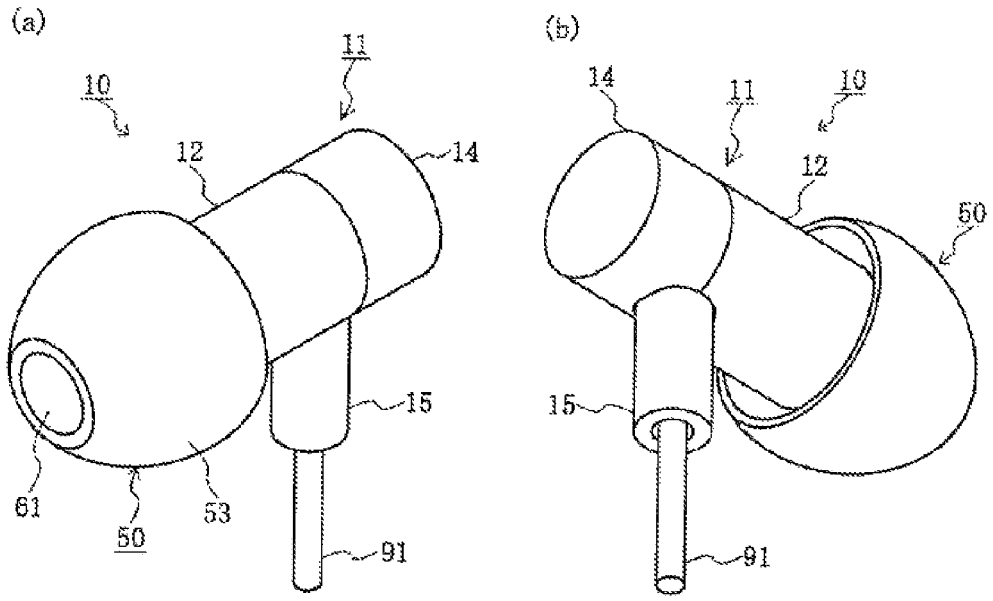
FIG. 1 is a perspective drawing of the earphone according to the first implementation mode of this Present Disclosure, wherein (a) is a view from an upper oblique and (b) is a view from a lower oblique.
Figure 2:
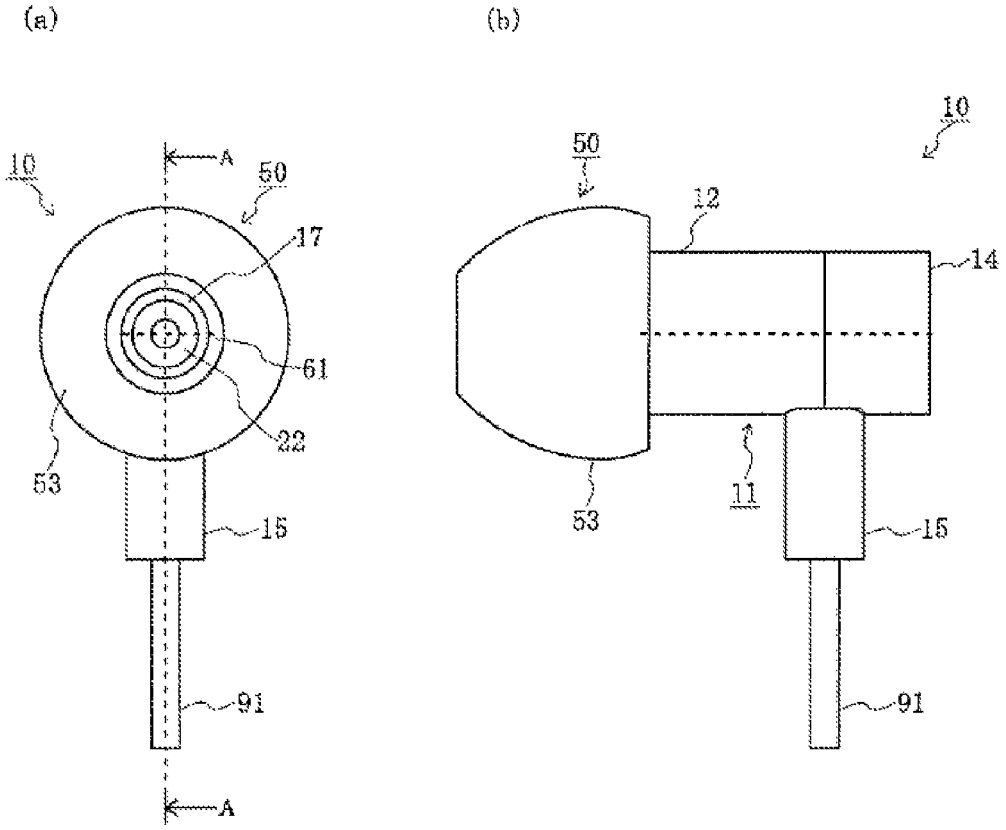
FIG. 2 is a two surface drawing of the earphone according to the first implementation mode of this Present Disclosure, wherein (a) is a front surface drawing and (b) is a side surface drawing.
Figure 3:
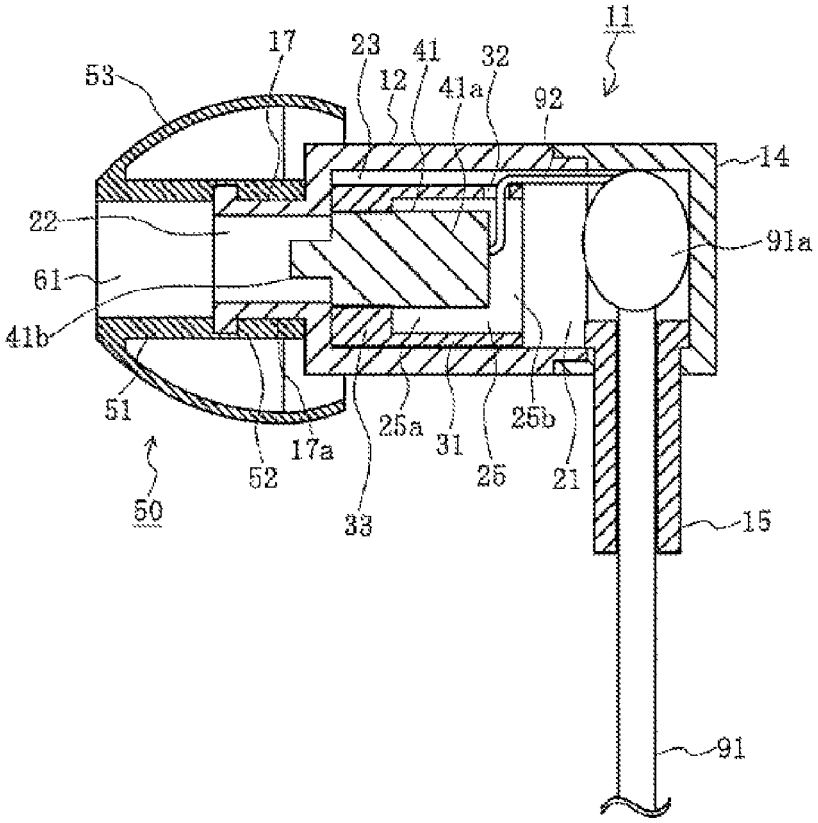
FIG. 3 is a cross section drawing of the earphone according to the first implementation mode of this Present Disclosure, being a cross section drawing along the line A-A in FIG. 2.

The following section describes in detail a mode for implementing this Present Disclosure, while referencing the drawings. FIG. 1 is a perspective drawing of the earphone according to a first implementation mode of the Present Disclosure, FIG. 2 is a two surface drawing of the earphone according to the first implementation mode of the Present Disclosure, and FIG. 3 is a cross section drawing of the earphone according to the first implementation mode of the Present Disclosure. In FIG. 1, (a) is a view from an upper oblique and (b) is a view from a lower oblique. In FIG. 2, (a) is a front surface drawing and (b) is a side surface drawing. FIG. 3 is a cross section drawing along the line A-A in FIG. 2.

In the drawings, 10 is the earphone according to this implementation mode, and it is a compact audio generator that reproduces an audio signal, being used by mounting on the outer ear of the user, and driven by an audio signal that is an electric signal. Earphone 10 possesses housing 11 that functions as a casing which internally stores driver unit 41 functioning as a speaker unit to generate sound by reproducing the audio signal, and it possesses ear pad 50 that is installed on housing 11 and that functions as an outer ear canal insertion member for which at least the leading end can be inserted into the outer ear canal of the user.

Housing 11 provides main housing 12 positioned at the front surface side, and cover casing 14 connected to the aft side of main housing 12. As shown by FIG. 3, driver unit 41 is maintained within interior space 21 formed at the interior side of main housing 12. The aft surface of housing 12 is plugged by cover casing 14.

Driver unit 41 can be of any type, as long as it generates sound by reproducing the audio signal, but this section describes an instance in which it is a so-called balanced armature type, of an approximate box shape, specifically, that which possesses an approximately rectangular external shape. In this instance, driver unit 41 provides box-shaped unit body 41*a* as well as unit protrusion 41*b* that protrudes from the front surface of unit body 41*a*, and the unit emits sound from sound release opening formed on the front surface of unit protrusion 41*b*.

Housing 11 is constituted of a resin such as a synthetic resin, for example, although it can be constituted of a metal such as aluminum, steel or copper, or constituted of a composite substance that combines such as a resin, carbon and a metal.

With this implementation mode, expressions used to describe the structure and operation of each component of earphone 10, such as those referring to directions upper, lower, left, right, forward, and aft, are relative and not absolute, and they are suited to the attitude of earphone 10 and its parts shown in the drawings, but a change these expressions would be expected in conjunction with a change of the attitude, in the event that the attitude of earphone 10 or its parts were changed.

To housing 11 there is installed the upper end of cylinder-shaped cable retainer 15 that encompasses and retains a portion of electric cable 91 being the cable for which one end is connected to driver unit 41. The leading end of lead wire 92 exposed from the upper end of electric cable 91 is connected with conductive capacity to driver unit 41 by a connection means such as solder. If the leading end of electric cable 91 is pulled from the outer side, there exists the possibility that the connection component between the leading end of lead wire 92 and driver unit 41 will be broken and that electric cable 91 will be separated from housing 11 and cable retainer 15. For that reason, knot 91*a* is formed in the vicinity of the end of electric cable 91 and housed in the space within cover casing 14.

Electric cable 91 extends from the lower end of cable retainer 15. Regarding display within the drawings, only the portion of electric cable 91 in the proximity of cable retainer 15 is depicted, and the remaining portion is not depicted. Correspondingly, to the end of electric cable 91 not shown in the drawings there exists opposite end lead wire 92, which is connected with conductive capacity to an audio device such as a music player, television, radio, or video deck, not shown in the drawings.

Main housing 12 incorporates cylinder-shaped pad installation section 17 that protrudes in the forward direction (left direction in FIG. 3). At pad installation section 17 there is formed housing acoustic conduit 22, functioning as an acoustic conduit, for which the aft end passes through to interior space 21 of main housing 12 and the forward end is an open cylinder-shaped opening. As as result, sound generated by driver unit 41 is emitted from the sound release opening formed on the front surface of unit protrusion 41*b*, passes through housing acoustic conduit 22, and thereafter enters the outer ear canal of the user.

Ear pad 50 is installed onto pad installation section 17. Ear pad 50 is a single body member constituted of a soft material able to pliably deform such as silicon rubber, for example, and it provides cylinder-shaped main body 51 which is fitted to the periphery of pad installation section 17, and provides hood 53 as an elastically deforming section that widens in a slope from the leading end to the aft end of main body 51. To the aft end of main body 51 there is additionally formed body thickness flange-shaped mating protrusion 52 that projects toward the interior. Mating protrusion 52 mates with channel-shaped mating cavity 17*a* (a section for connecting to main housing 12) that is formed at the base end of pad installation section 17, and this prevents ear pad 50 from separating from pad installation section 17.

Ear pad 50 possesses an overall shape similar to that of a mushroom or umbrella, and at the related leading end section, the leading end of hood 53 is connected to the leading end of main body 51, and a cavity is formed in the space between the outer periphery of main body 51 and hood 53. At the center of main body 51 there is formed pad acoustic conduit 61 functioning as an acoustic conduit with the forward and aft ends being open cylindrical openings. In the state in which ear pad 50 has been installed onto pad installation section 17, pad acoustic conduit 61 links with housing acoustic conduit 22.

Hood 53 provides flexibility by being thinner than the thickness of main body 51, and therefore with ease it can be elastically deformed by reception of force. Accordingly, when ear pad 50 has been inserted into the outer ear canal, hood 53 elastically deforms to adapt to the inner surface shape of the outer ear canal, resulting in a sense of secure mounting and comfortable fit, without damaging the outer ear canal and without applying a reactive force against the inner surface of the outer ear canal.

With this implementation mode, as shown in FIG. 3, driver unit 41 is installed to housing 11 by means of cylinder-shaped unit support component 31, which functions as the support member installed within housing 11. Unit support component 31 is an integrally formed member constituted of a soft material, it is installed to main housing 12 such that its outer surface is maintained by the inner surface of main housing 12, and it houses and supports driver unit 41 within support interior space 25 which is the related interior space. For example, driver unit 41 is installed by being pressed inward to within unit support component 31, and unit support component 31 is installed by being pressed inward to within main housing 12. The material of unit support component 31 can be of any type as long as it is rigid, and therefore it can be of a metal such as aluminum, steel or copper, or it can be constituted of a resin such as plastic, or it can be constituted of a compound material that has combined such as a resin, carbon and metal, for example.

Furthermore, in unit support component 31 there is formed cord passage hole 32 functioning as a passage hole which passes through a portion of the side wall in the thickness direction. Lead wire 92 is wired so as to pass from the upper end of electric cable 91 and through cord passage hole 32, and the related leading end is connected to driver unit 41 housed within unit support component 31. In this way, lead wire 92 is prevented from displacing to a condition of sagging to within interior space 21 or support interior space 25, and by the presence of lead wire 21 there will be no loss of function as an acoustic space for interior space 21 and support interior space 25.

It is preferable that the shape of unit support component 31, rather than being a complete cylinder shape in cross section, be a shape for which one portion of the side wall be flat, at a location orthogonal to an portion of the cross section that is an arc. In this way, there is formed support component exterior space 23 between the portion of the side wall that is flat and the inner surface of housing 11. This more reliably prevents displacement of lead wire 92, and more reliably prevents loss of function as an acoustic space for interior space 21 and support interior space 25 due to the presence of lead wire 21.

Moreover, on the inner surface of unit support component 31 there is formed a plurality of internal rib 33 in a shape projecting inward and functioning as a unit support protrusion. In this way, unit body 41*a* of driver unit 41 housed within support interior space 25 of unit support component 31 is supported by internal rib 33. Specifically, there is entered a state in which the leading edge of internal rib 33 has contacted the outer surface of unit body 41*a*, and this is a state in which the outer surface of driver unit 41 is separated from the inner surface of unit support component 31. This enables the firm maintaining of box-shaped unit body 41*a* within support interior space 25 of unit support component 31 without the possibility of displacement. Additionally, this forms side space 25*a* within support interior space 25, between the inner side surface of unit support component 31 and the outer side surface of unit body 41*a*, specifically, at the outer side of the side surface of driver unit 41. Additionally, the disposing of internal rib 33 enables adjustment of the resonance (response) between driver unit 41 and unit support component 31.

Moreover, it is preferable that the length of unit support component 31 (the dimension of the left and right direction in FIG. 3) be longer than the length of unit body 41*a* of driver unit 41. This will result in the forming of aft space 25*b* within support interior space 25 rearward of unit body 41*a*, specifically, rearward of the aft surface of driver unit 41.

In this way, with this mode of implementation, driver unit 41 is maintained with high precision in the placement, and with no displacement within housing 11, by using rigid unit support component 31 installed within housing 11 to support the outer surface of driver unit 41. Furthermore, driver unit 41 will be reliably maintained within housing 11 even if its shape differs from the shape of housing 11. There is also enabled maintaining of side space 25*a* as a space between the outer surface of unit body 41*a* of driver unit 41 and the inner surface of unit support component 31, as well as aft space 25*b* . Side space 25*a* and aft space 25*b* will thereby always be maintained in a uniform size and shape, securing their function as acoustic spaces, with the result that the sound quality of earphone 10 will be improved and fixed. Additionally, driver unit 41 and unit support component 31 are installed by pressure insertion, without using such as an adhesive, thereby improving the assembly process for earphone 10 and enabling reductions in both manufacturing time and manufacturing cost. Moreover, because installation is by pressure insertion, without using such as an adhesive, there is ability to replace such as driver unit 41, and this enables prevention of a drop in sound quality.

Figure 4:
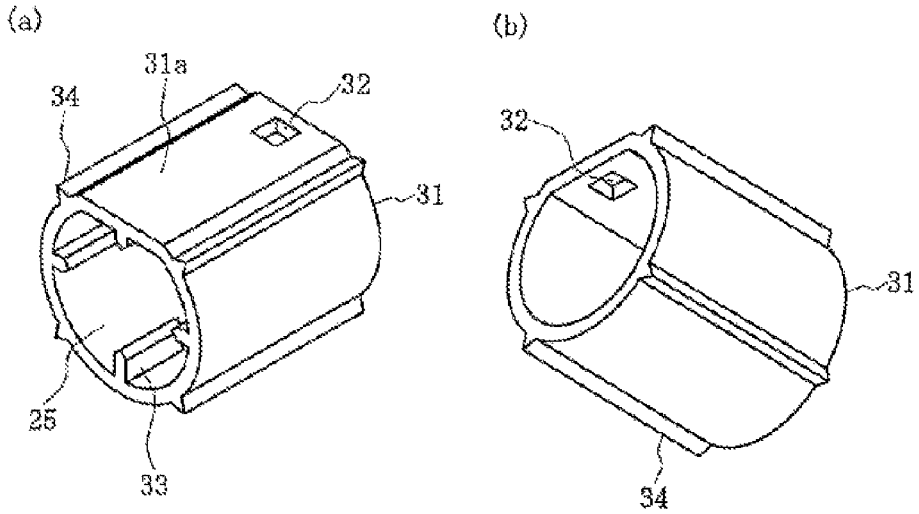
FIG. 4 is a perspective drawing of the unit support component according to the first implementation mode of this Present Disclosure, wherein (a) is a view from an upper oblique and (b) is a view from a lower oblique.
Figure 5:
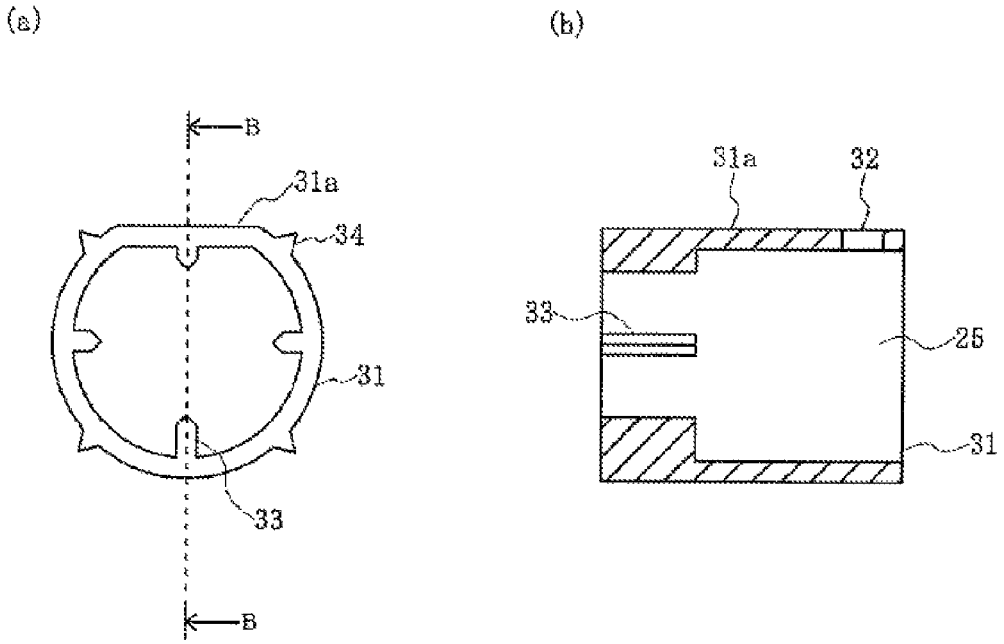
FIG. 5 is a two surface drawing of the unit support component according to the first implementation mode of this Present Disclosure, wherein (a) is a front surface drawing, (b) is a cross section drawing along the line B-B in FIG. 5 (a)
Figure 6:
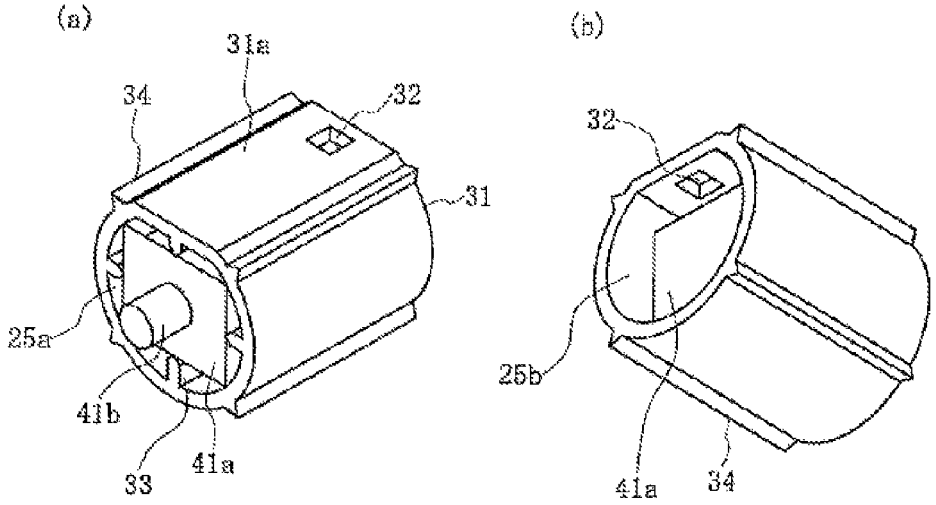
FIG. 6 is a perspective drawing of the unit support component with the driver unit installed according to the first implementation mode of this Present Disclosure, wherein (a) is a view from an upper oblique and (b) is a view from a lower oblique.
Figure 7:
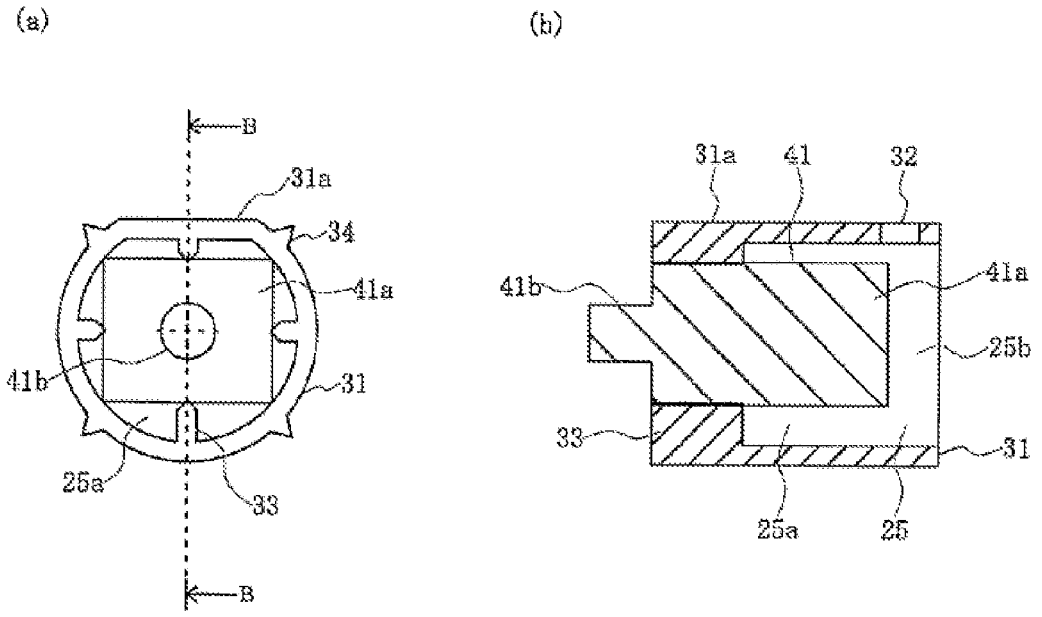
FIG. 7 is a two surface drawing of the unit support component with the driver unit installed according to the first implementation mode of this Present Disclosure, wherein (a) is a front surface drawing, (b) is a cross section drawing along the line B-B in FIG. 7 (a)

The following section describes in detail the state of driver unit 41 installation within unit support component 31. FIG. 4 is a perspective drawing of the unit support component according to the first implementation mode of this Present Disclosure, FIG. 5 is a two surface drawing of the unit support component according to the first implementation mode of this Present Disclosure, FIG. 6 is a perspective drawing of the unit support component with the driver unit installed according to the first implementation mode of this Present Disclosure, and FIG. 7 is a two surface drawing of the unit support component with the driver unit installed according to the first implementation mode of this Present Disclosure. In FIGS. 4 and 6, (a) is a view from an upper oblique and (b) is a view from a lower oblique; and in FIGS. 5 and 7, (a) is a front surface drawing, (b) is a cross section drawing along the line B-B in related figure (a).

In the examples of FIG. 4~7, internal rib 33 is formed in a quantity of 4 with approximately equal separation, but the quantity and placement of internal rib 33 can be changed for convenience. Furthermore, when the cross section shape of unit body 41*a* being supported by internal rib 33 is a square box shape such as that shown in FIG. 7 (a), it is preferable that internal rib 33 be formed in a quantity of 4 with approximately equal separation.

In addition, in the examples of FIG. 4~7, internal rib 33 extends from the front end of unit support component 31 only within a range of a prescribed distance, and that length (the dimension of the left and right direction in FIG. 5 (b) and FIG. 7 (b)) is shorter than the length of unit support component 31, and it is shorter than the length of unit body 41*a*, but it is acceptable to make the length approximately identical to the length of unit body 41*a*, and it is acceptable to make the length approximately identical to the length of unit support component 31. Specifically, the length of internal rib 33 can be changed for convenience.

By forming internal rib 33 such that it extends from the front end of unit support component 31 only within a range of a prescribed distance, there is ability to adjust the resonance (response) between driver unit 41 and unit support component 31. Furthermore, this reduces resistance at time of pressure inserting driver unit 41 to within unit support component 31, thereby improving the assembly process for earphone 10.

Additionally, in the examples of FIG. 4~7, on the outer surface of unit support component 31 there is formed a plurality (a quantity of four in the examples shown in the drawings) of external rib 34 as a support protrusion that protrudes in the outward direction. Unit support component 31 housed within main housing 12 is supported by external rib 34. Specifically, the leading end of external rib 34 is in a state that has contacted the inner surface of main housing 12. By disposing external rib 34 there is ability to adjust the resonance (response) between main housing 12 and support component 31. The quantity and placement of external rib 34 can be changed for convenience. It is also possible to omit external rib 34 if necessary.

Furthermore, in the examples of FIG. 4~7, one portion of the side wall of unit support component 31 has been made flat. In the drawings, 31*a* is the component of the side wall that has been made flat, specifically, this symbol identifies the flat component. Within flat component 31*a* is formed cord passage hole 32.

As shown in FIGS. 6 and 7, between the four side surfaces of unit body 41*a* and the side wall of unit support component 31 there is formed side space 25*a*. Within support interior space 25 rearward of unit body 41*a* there is formed aft space 25*a*. Side space 25*a* and aft space 25*b* are linked, and they are always maintained in a fixed size and shape, thereby contributing to a superior function as an acoustic space. In particular, when internal rib 33 extends from the front end of unit support component 31 only within a range of a prescribed distance, the connection between side space 25*a* and aft space 25*b* is smooth, and this further contributes to the function as an acoustic space.

In this way, earphone 10 according to this implementation mode possesses ear pad 50, housing 11 onto which ear pad 50 is installed, and driver unit 41 that is disposed within housing 11 and that generates sound, and driver unit 41 is supported at its outer surface by rigid unit support component 31 installed within housing 11.

This enables supporting of driver unit 41 within housing 11, with high precision in the placement and with no possibility for displacement, while using a simple structure. In addition, there can be maintained a space between the outer surface of driver unit 41 and the inner surface of unit support component 31. This allows the space to make an ample contribution as an acoustic space, and it makes uniform that function as an acoustic space, with the result that high quality audio can be obtained, even if earphone 10 is made compact.

Furthermore, because driver unit 41 and unit support component 31 are installed by pressure insertion, the assembly process for earphone 10 is improved, enabling reductions in both manufacturing time and manufacturing cost.

Because lead wire 92 is wired such that it passes from the upper end of electric cable 91 through a portion of support component exterior space 23 and through cord passage hole 32, there is no displacement to a state in which lead wire 92 sags downward, and there is ability to prevent breakage of the connection location between lead wire 92 and driver unit 41.

Figure 8:
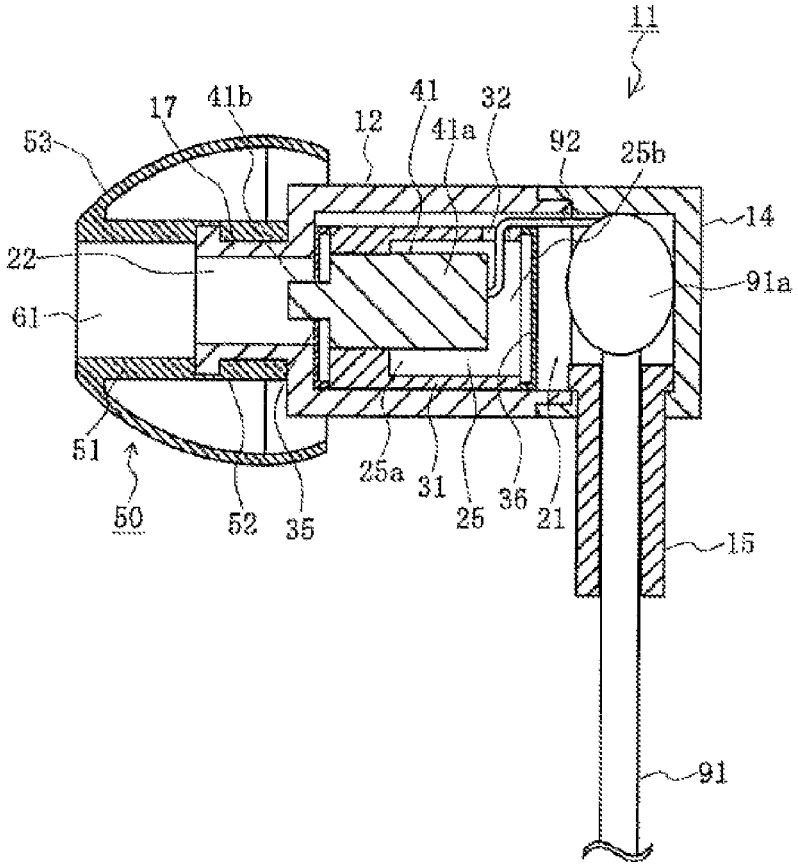
FIG. 8 is a cross section drawing of the earphone according to the second implementation mode of this Present Disclosure, being a drawing that corresponds to FIG. 3.
Figure 9:
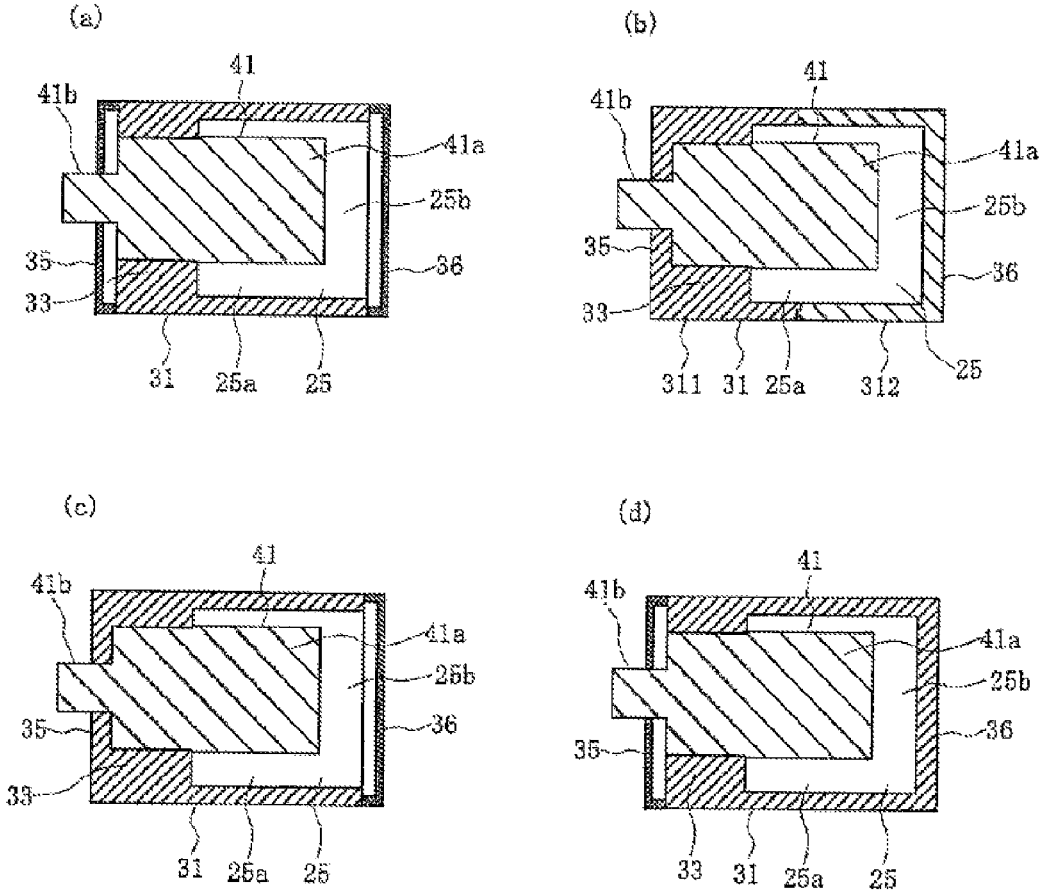
FIG. 9 is a first cross section drawing of the unit support component with the driver unit installed according to the second implementation mode of this Present Disclosure, it corresponds to FIG. 7 (b), and sections (a)-(d) show differing specific examples of the partition.
Figure 10:
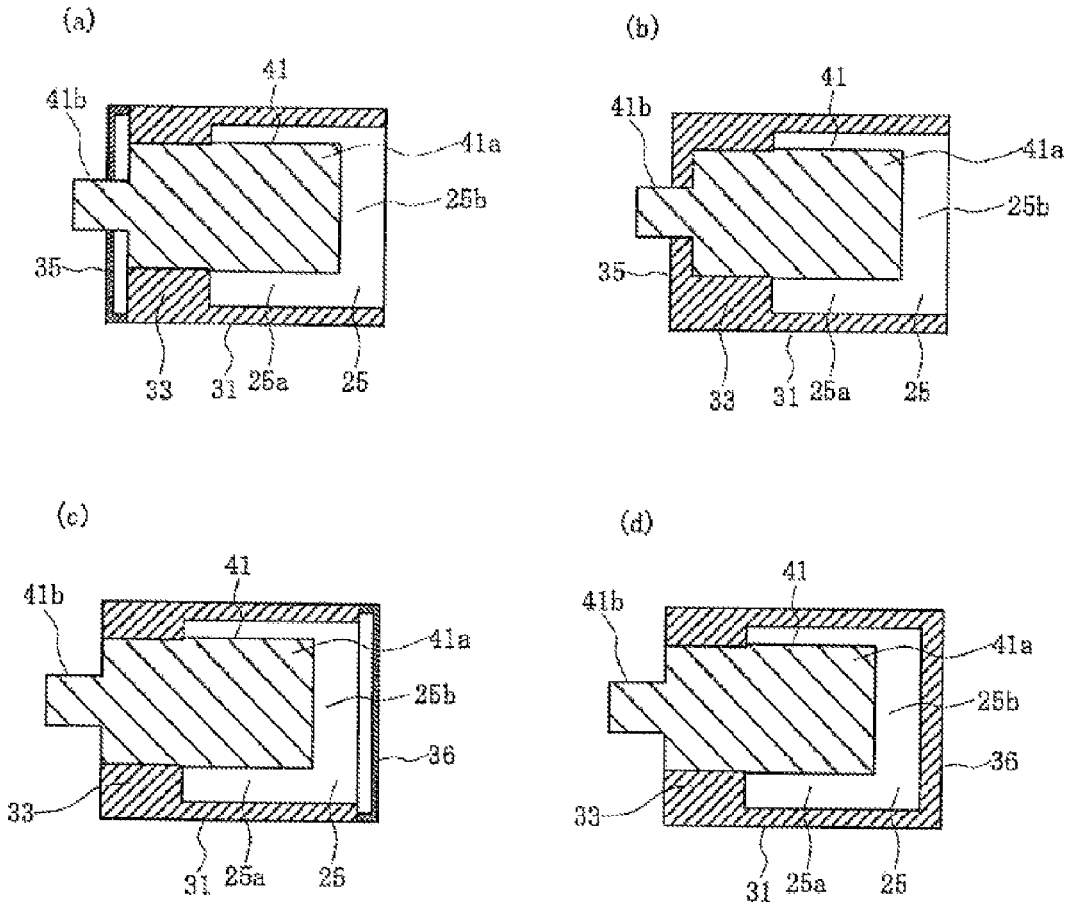
FIG. 10 is a second cross section drawing of the unit support component with the driver unit installed according to the second implementation mode of this Present Disclosure, it corresponds to FIG. 7 (b), and sections (a)-(d) show differing specific examples of the partition.

The following section describes a second implementation mode of this Present Disclosure. For items that possess the same structure as that of the first implementation mode, the same symbols are utilized and the related explanations are omitted. Furthermore, for operations and effects that are the same as that of the first implementation mode, the related explanations are omitted. FIG. 8 is a cross section drawing of the earphone according to a second implementation mode of this Present Disclosure, being a drawing that corresponds to FIG. 3, FIG. 9 is a first cross section drawing of the unit support component with the driver unit installed according to the second implementation mode of this Present Disclosure, being a drawing that corresponds to FIG. 7 (b), and FIG. 10 is a second cross section drawing of the unit support component with the driver unit installed according to the second implementation mode of this Present Disclosure, being a drawing that corresponds to FIG. 7 (b). Sections (a)~(d) in FIGS. 9 and 10 show differing specific examples of the partition.

With this implementation mode, there is disposed, as a head at the front surface and/or rear surface of unit support component 31, a bulkhead, specifically, a partition. In the example shown in FIGS. 8 and 9 (a), forward plate 35 and aft plate 36 are disposed as heads, specifically, as partitions, at the front surface and/or rear surface of unit support component 31. Moreover, in the example shown in FIG. 9 (a), flat component 31*a* and cord passage hole 32 are omitted to facilitate the explanation.

Forward plate 35 has the primary purpose of preventing the entry of foreign matter such as dust to within support interior space 25 after having passed from the exterior through pad acoustic conduit 61 and housing acoustic conduit 22, and it is placed so as to cover the front surface of unit support component 31 and driver unit 41. Forward plate 35 can be fixed to the front end of unit support component 31 by an fastening means such as an adhesive, for example, or it can be left unfastened. Furthermore, in the center of forward plate 35 there is formed a passage hole to allow unit protrusion 41*b* of driver unit 41 to pass, and thereby the sound release opening formed on the front surface of unit protrusion 41*b* is placed forward of forward plate 35, and the sound generated by driver unit 41 is emitted from the sound release opening.

In this way, by disposing forward plate 35 at the front surface of unit support component 31, there is ability to prevent foreign matter protrusion to within support interior space 25, ability to maintain the clean state of support interior space 25, and ability to prevent loss of function as an acoustic space for support interior space 25.

Additionally, aft plate 36 has the primary purpose of preventing the entry of electric cable 91 and knot 91*a* to within support interior space 25, and it is placed so as to cover the aft surface of unit support component 31 and driver unit 41. Electric cable 91 and knot 91*a* are housed within the space inside cover casing 14, but they are not secured in that location by any means, and a possibility of shifting to within interior space 21 of main housing 12 therefore exists. For this reason, in the event of an external force such as a shock is applied to earphone 10, for example, if the aft surface of unit support component 31 were to be released, there would result a possibility of electric cable 91 and knot 91*a* intruding to within support interior space 25.

Therefore, by placing aft plate 36 at the aft surface of unit support component 31, there is ability to prevent electric cable 91 and knot 91*a* from intruding to within support interior space 25, ability to uniformly maintain the spatial volume of support interior space 25, and ability to prevent loss of function as an acoustic space for support interior space 25. In addition, this prevents electric cable 91 and knot 91*a* from contacting driver unit 41 and thereby decreasing the quality of the sound generated by driver unit 41. aft plate 36 can be fixed to the aft end of unit support component 31 by an fastening means such as an adhesive, for example, or it can be left unfastened.

Moreover, forward plate 35 and aft plate 36 can be constituted of any material, and therefore, as with unit support component 31, it is acceptable that they be of a metal such as aluminum, steel or copper, or it can be constituted of a resin such as plastic, or it can be constituted of a compound material that has combined such as a resin, carbon and metal, for example. Additionally, the thickness of forward plate 35 and aft plate 36 can be discretionarily set, and therefore it is acceptable to use a thickness identical to the side wall of unit support component 31, for example, or to use a thinner thickness, or to use the thickness of a membrane or film, and thereby contribute to the resonance (response) function.

Furthermore, forward plate 35 and aft plate 36 can be formed as a member separate from unit support component 31, or they can be formed integrally with unit support component 31.

In the example shown in FIG. 9 (b), unit support component 31 comprises forward half component 311 and aft half component 312. Forward plate 35 is integrally formed at the front end of forward half component 311, and the outline shape of forward half component 311 is a bottom included cylindrical container such as a cup with forward plate 35 as the bottom. Additionally, aft plate 36 is integrally formed at the aft end of aft half component 312, and the outline shape of aft half component 312 is a bottom included cylindrical container such as a cup with aft plate 36 as the bottom. Moreover, internal rib 33 is formed only on forward half component 311. Then, by joining forward half component 311 and aft half component 312, there is enabled obtaining of unit support component 31 for which forward plate 35 is disposed at the front surface and aft plate 36 is disposed at the aft surface. Other features are identical to the example shown in FIG. 9 (a), and therefore descriptions are omitted.

It is also acceptable for forward plate 35 to be a member integrally formed with unit support component 31, while aft plate 36 is a member formed separately from unit support component 31.

In the example shown in FIG. 9 (c), forward plate 35 is integrally formed at the front end of unit support component 31, and the outline shape of unit support component 31 is a bottom included cylindrical container such as a cup with forward plate 35 as the bottom. aft plate 36 is placed at the aft surface of unit support component 31. Other features are identical to the example shown in FIG. 9 (a), and therefore descriptions are omitted.

It is also acceptable for forward plate 35 to be a member formed separately from unit support component 31, while aft plate 36 is a member integrally formed with unit support component 31.

In the example shown in FIG. 9 (d), aft plate 36 is integrally formed at the aft end of unit support component 31, and the outline shape of unit support component 31 is a bottom included cylindrical container such as a cup with aft plate 36 as the bottom. Forward plate 35 is placed at the front surface of unit support component 31. Other features are identical to the example shown in FIG. 9 (a), and therefore descriptions are omitted.

It is also acceptable to omit one of either forward plate 35 or aft plate 36. It also acceptable to arrange such that forward plate 35 or aft plate 36 are disposed as a partition at the front surface or aft surface of unit support component 31.

In the examples shown in FIGS. 10 (a) and 10 (b), aft plate 36 is omitted. Therefore, in the example shown in FIG. 10 (a), forward plate 35 is placed at the front surface of unit support component 31, but aft plate 36 is not placed at the aft surface of unit support component 31. In the example shown in FIG. 10 (b), forward plate 35 is integrally formed at the front end of unit support component 31, and unit support component 31 is a bottom included cylindrical container such as a cup with forward plate 35 as the bottom, but aft plate 36 is not placed at the aft surface of unit support component 31. Other features are identical to the example shown in FIG. 9 (a), and therefore descriptions are omitted.

In the examples shown in FIGS. 10 (c) and 10 (d), forward plate 35 is omitted. Therefore, in the example shown in FIG. 10 (c), aft plate 36 is placed at the aft surface of unit support component 31, but forward plate 35 is not placed at the front surface of unit support component 31. In the example shown in FIG. 10 (d), aft plate 36 is integrally formed at the aft end of unit support component 31, and unit support component 31 is a bottom included cylindrical container such as a cup with aft plate 36 as the bottom, but forward plate 35 is not placed at the front surface of unit support component 31. Other features are identical to the example shown in FIG. 9 (a), and therefore descriptions are omitted.

In this way, with this implementation mode, a partition was disposed at the front surface and/or the aft surface of unit support component 31. This enables reliable preventing the intrusion of foreign matter to within support interior space 25, and enables preventing loss of function as an acoustic space for support interior space 25. Additionally, the front and/or the rear of support interior space 25 are demarcated by a partition, thereby enabling the maintaining of a uniform spatial volume within support interior space 25 functioning as an acoustic space, and thereby enabling the obtaining of high sound quality.

Figure 11:
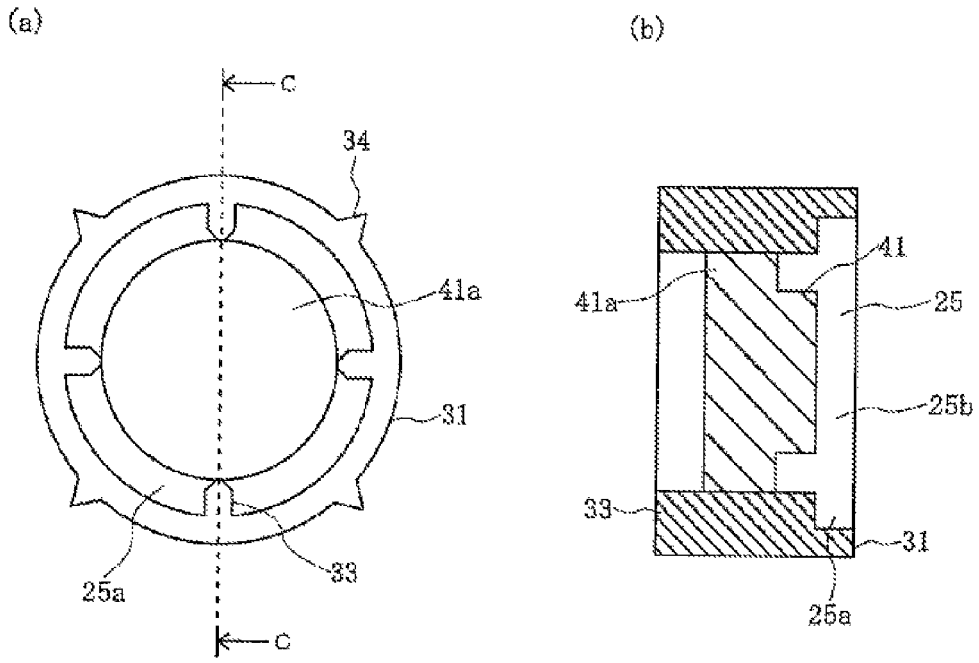
FIG. 11 is a two surface drawing of the unit support component with driver unit installed according to the third implementation mode of this Present Disclosure, wherein (a) is a front surface drawing, (b) is a cross section drawing along the line C-C in FIG. 11 (a)
Figure 12:
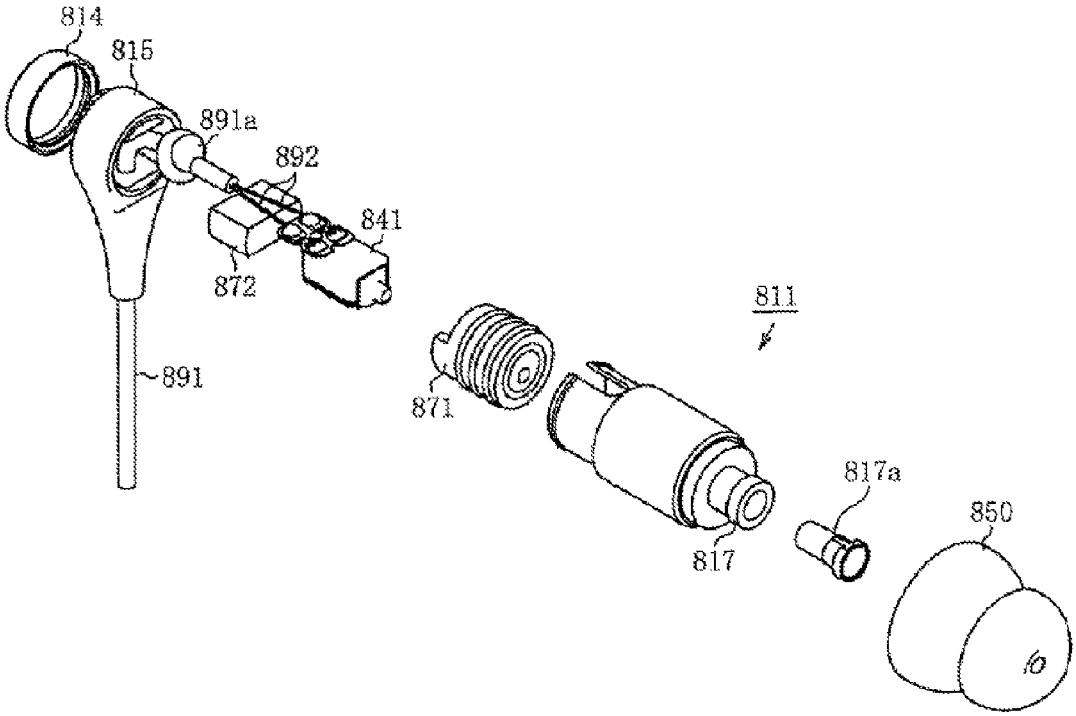
FIG. 12 is an explode view drawing that shows the structure of the former technology earphone.

The following section describes a third implementation mode of this Present Disclosure. For items that possess the same structure as that of the first and second implementation modes, the same symbols are utilized and the related explanations are omitted. Furthermore, for operations and effects that are the same as that of the first and second implementation modes, the related explanations are omitted. FIG. 11 is a two surface drawing of the unit support component with driver unit installed according to a third implementation mode of this Present Disclosure. In the drawing, (a) is a front surface drawing, (b) is a cross section drawing along the line C-C in FIG. 11 (a).

In the first and second implementation modes, examples were described wherein driver unit 41 was a so-called balanced armature type, of an approximate box shape, specifically, that which possesses an approximately rectangular external shape. However, in this implementation mode, there is described an example wherein driver unit 41 is a so-called dynamic type, internally providing a magnet, plate and yoke to form an electromagnetic circuit as well as a vibration plate and voice coil to form a vibration system; and the unit is approximately disc shaped, specifically, it possesses an columnar external shape for which the height dimension is shorter than the diameter.

As shown in the drawing, unit support component 31 is a completely round cylindrical shape as seen in cross section, and on the inner surface of unit support component 31 there is formed a plurality (a quantity of four in the example shown in the drawing) of internal rib 33 in a shape projecting inward and functioning as a unit support protrusion. Unit body 41*a* of driver unit 41 housed within support interior space 25 of unit support component 31 is supported by internal rib 33. Specifically, the leading end of internal rib 33 is in a state of having contacted the outer surface of unit body 41*a*. This enables the firm maintaining of disc-shaped unit body 41*a* within support interior space 25 of unit support component 31 without the possibility of displacement. Additionally, this forms side space 25*a* within support interior space 25, between the inner side surface of unit support component 31 and the outer side surface of unit body 41*a*.

In the example shown in the drawing, the length of internal rib 33 (the dimension of the left and right direction in FIG. 11 (b)) is shorter than the length of unit support component 31, but it is longer than the length of unit body 41*a*. This enables firm maintaining of driver unit 41, even when it is of the dynamic type for which the length of unit body 41*a* is short.

Other features are identical to those of the first and second implementation modes, and therefore descriptions are omitted.

While a preferred embodiment of the Present Disclosure is shown and described, it is envisioned that those skilled in the art may devise various modifications without departing from the spirit and scope of the foregoing Description and the appended Claims.

What is claimed is:

1. An earphone, the earphone comprising:

an outer ear canal insertion member, a portion of which is inserted into the outer ear canal;

a housing onto which the outer ear canal insertion member is disposed;

a driver unit, the driver unit being disposed within the housing and which generates sound; and a support member, the support member being disposed within the housing and supporting the driver unit, the support member including at least one external rib, the external rib shaped to provide a support component exterior space between an outer surface of the support member and an inner surface of the housing, and extending the length of the support member to allow air to travel the length thereof, air further being permitted to flow into the exterior space from a rear end of the support member;

wherein the driver unit is supported within an inner space of the support member due to the support member being disposed within the housing.

2. The earphone of claim 1, wherein the support member includes a plurality of unit support protrusions that protrude toward the inward direction.

3. The earphone of claim 2, wherein the outer surface of the driver unit is separated from the inner surface of the support member by contact against the unit support protrusions.

4. The earphone of claim 3, wherein a partition is disposed at a front surface of the support member.

5. The earphone of claim 3, wherein the inner space of the support member includes a side space at the outer side of the side surface of the driver unit as well as an aft space to the aft of an aft surface of the driver unit.

6. The earphone of claim 5, wherein the side space and aft space are linked.

7. The earphone of claim 6, wherein a partition is disposed at a front surface of the support member.

8. The earphone of claim 1, wherein the inner space of the support member includes a side space at the outer side of the side surface of the driver unit as well as an aft space to the aft of an aft surface of the driver unit.

9. The earphone of claim 8, wherein the side space and aft space are linked.

10. The earphone of claim 9, wherein a partition is disposed at a front surface of the support member.

11. The earphone of claim 1, wherein a partition is disposed at a front surface of the support member.

12. The earphone of claim 3, wherein a partition is disposed at an aft surface of the support member.

13. The earphone of claim 6, wherein a partition is disposed at an aft surface of the support member.

14. The earphone of claim 9, wherein a partition is disposed at an aft surface of the support member.

15. The earphone of claim 1, wherein a partition is disposed at an aft surface of the support member.

16. The earphone of claim 1, wherein the external ribs are positioned to adjust the resonance between the housing and the support member.

* * * * *